US005960993A

United States Patent [19]

Mitsui et al.

[11] Patent Number: 5,960,993

[45] Date of Patent: Oct. 5, 1999

[54] CONTAINER FOR FLUIDAL MATERIALS READILY COLLAPSIBLE TO FLATTENED SHAPE AFTER USE

[75] Inventors: Noriaki Mitsui, Shinjuku-ku; Toru Takemura; Takahiro Wakayama, both of Minato-ku, all of Japan

[73] Assignee: Riso Kagaku Corporation, Tokyo, Japan

[21] Appl. No.: 09/016,948

[22] Filed: Feb. 2, 1998

[30] Foreign Application Priority Data

Feb. 10, 1997 [JP] Japan ..... 939712

[51] Int. Cl.[6] ..... B65D 35/00

[52] U.S. Cl. ..... 222/92; 222/107; 222/105

[58] Field of Search ..... 222/92, 105, 107, 222/143; 229/117.05

[56] References Cited

U.S. PATENT DOCUMENTS 5,176,294 1/1993 Della Riva ..... 222/105

FOREIGN PATENT DOCUMENTS

| | | |
|---|---|---|
| 804 959 | 11/1936 | France . |
| 40 28 507 | 3/1992 | Germany . |
| 25-3067 | 5/1925 | Japan . |
| A-59-37162 | 2/1984 | Japan . |
| A-59-37163 | 2/1984 | Japan . |
| 60-94275 | 6/1985 | Japan . |
| 62-82977 | 5/1987 | Japan . |
| 2-3830 | 1/1990 | Japan . |
| 3-24378 | 5/1991 | Japan . |
| A-5-82858 | 4/1993 | Japan . |
| 5-82858 | 11/1993 | Japan . |
| 5-95878 | 12/1993 | Japan . |
| A-6-199349 | 7/1994 | Japan . |
| 7-223689 | 8/1995 | Japan . |
| 2503067 | 4/1996 | Japan . |
| A-8-260344 | 10/1996 | Japan . |
| A-62-3438 | 1/1997 | Japan . |
| A-9-39712 | 2/1997 | Japan . |
| 902 241 | 8/1962 | United Kingdom . |
| 1 024 241 | 3/1966 | United Kingdom . |

*Primary Examiner*—Gregory L. Huson
*Attorney, Agent, or Firm*—Oliff & Berridge, PLC

[57] ABSTRACT

A container for fluidal materials, including a bag member made of a flexible film material originally constructed in a flattened shape with some foldings, a port member mounted to the bag member at its longitudinal end, and a plate member mounted over the bag member as originally constructed in a flattened annular sheet member made of a relatively stiff and elastic sheet material such as a cardboard, wherein the plate member is expanded into a tubular shape when the bag member is charged with a fluidal material but is readily flattened for disposal after the fluidal material has been discharged from the bag member.

9 Claims, 8 Drawing Sheets

CONTAINER FOR FLUIDAL MATERIALS READILY COLLAPSIBLE TO FLATTENED SHAPE AFTER USE

BACKGROUND OF THE INVENTION

1. Field of the Invention

The present invention related to a container for fluidal materials, and more particularly, to a container for fluidal materials readily collapsible to a flattened shape.

2. Description of the Prior Art

When a viscous fluidal material such as the modern printing ink is supplied from a container serving as a source of the material in a machine such as a printer, one of the important matters to be cared for is that the container is prepared to decrease its effective inside space volume according to discharge of the material from the container, because, otherwise, a smooth discharge of the material will soon be obstructed by a reversed pressure gradient applied to a discharge port of the container as a vacuum is generated in the container, provided that the container has a rigid construction. On the other hand, when the container has a flexible construction like a toothpaste tube, while a material is discharged from the container by a drawing action applied to a discharge port from the outside thereof, the discharge of the material will not be immediately obstructed, but it is highly probable that the drawing action applied to the discharge port soon contracts a lengthwise middle portion of the container before the drawing action is transmitted to the material in a rear portion of the container remote from the discharge port, so as finally completely to throttle the middle portion, thereby locking the material contained in the rear portion of the container to be no longer dischargeable regardless how strong the drawing action is.

In view of the above problems, in the art of the containers having a rigid construction, it has been proposed to construct the container as an assembly of a cylinder member and a piston member, the latter providing a bottom wall of the cylinder member movable along the axis thereof so as to decrease the effective inside space volume of the cylinder member according to a discharge of the material through a discharge port provided at an end of the cylinder member opposing the bottom wall provided by the piston member, as disclosed in Japanese Patent Laid-open Publications 59-37162 and 59-37163 and Japanese Utility Model Laid-open Publication 5-95878.

Further, under the recent concern about the conservation of nature, it has also been proposed to construct the containers for fluidal materials substantially by a film material in combination with a rigid case member, the latter serving as a means for providing the film-made configurationally unstable container with a firm configuration on one hand, while on the other hand serving as a means for supporting the film-made container from being throttled at a middle portion thereof when a fluidal material contained therein is discharged by a drawing action, particularly when the material is a viscous fluidal material, as disclosed in Japanese Utility Model Laid-open Publication 5-82858 and Japanese Utility Model Publication 2503067.

According to the Japanese Publication 5-82858, a container having an elongated body substantially made of a film material except a nozzle portion of a rigid construction, is housed in a rigid cylindrical case member, with the nozzle portion being fixed to the cylindrical case member, while the elongated film body is freely disposed in the cylindrical case member except a longitudinally middle portion thereof, at which the elongated film body is bonded to the case member, so that, when the fluidal material contained in the container is drawn out through the nozzle portion, a longitudinally half portion of the elongated film body remote from the nozzle portion is shifted toward the nozzle portion, so as to be finally turned over inside out, until the effective inside space of the container is finally almost completely canceled. When the container has been used, i.e. the material contained therein has been exhausted, the container is disassembled from the case member for disposal, while the case member is reused for a next new container through a process of inserting the container into the case member, and bonding the middle portion of the container to the case member.

According to the Japanese Utility Model 2503067, an elongated cylindrical container having a longitudinal half portion of a rigid construction and a longitudinal half portion of a flexible film bag construction is assembled with a nozzle member and an elongated cylindrical outer case member, such that the container is fixed to the nozzle member and the outer case member at an end of the rigid half portion remote from the flexible half portion coaxially disposed in the outer case member. When a fluidal material charged in the container is discharged therefrom by a pressure being applied to the outside of the container according to an introduction of a pressure medium into a chamber space formed between the container and the outer case member, the flexible half portion of the container is shifted into the rigid half portion thereof so to be finally turned over inside out, thereby canceling the effective inside space volume of the container. When the container has been used, the container is disassembled from the nozzle member and the outer case member for disposal.

In those above-mentioned prior arts, in order for the used container to be disposed at a minimum volume, a substantial work such as crushing the rigid container, disassembling the film-made container from the nozzle and the outer case member by breaking the bonding between the middle portion of the film-made container and the case member, or crushing the rigid half portion of the half film-made container, is required, all such works being highly liable to a contamination by the fluidal material such as ink.

SUMMARY OF THE INVENTION

In view of the above inconveniences to be suffered, if the space for disposal of the used containers is to be saved, it is a primary object of the present invention to provide an improved container for fluidal materials, particularly viscous fluidal materials, which is readily collapsible to be substantially flat when the content thereof has been discharged therefrom, while ensuring the content thereof being completely drawn out through a port opening provided in the container even when the content is a viscous fluidal material.

According to the present invention, such a primary object is accomplished by a container for fluidal materials, comprising:

a bag member made of a flexible film material, said bag member defining an inner space therein sealed against an outer atmosphere except a port opening formed therein, said bag member including a first and a second substantially rectangular portion adapted to show a same plane configuration when the container is in a flattened state, said first and second portions of said bag member being connected with one another along opposite side edges thereof so as to show a tubular configuration with opposite end edges thereof defining a pair of annular edges of the tubular configuration of said bag member when said inner space is charged with a fluidal material, said bag member further including a third portion closing one end of said tubular configuration along one of said pair of annular edges thereof except said port opening formed therein and a fourth portion closing another end of said tubular configuration along another of said pair of annular edges thereof, said third and fourth potions each being foldable to be substantially coplanar with said first and second portions when the container is in the flattened state, a port member mounted to said bag member at said third portion thereof, said port member defining a nozzle for discharging the fluidal material charged in the inner space of said bag member therefrom through said port opening of said bag member, and a plate member mounted over said bag member, said plate member including a first and a second substantially rectangular portion adapted to show a substantially same plane configuration when the container is in the flattened state, said first and second portions of said plate member being adapted to show a tubular configuration when said inner space is charged with the fluidal material, said plate member being fixed with said bag member such that a longitudinally half portion of said first and second portions of said bag member adjacent to said third portion thereof is maintained in a longitudinally extended state, while allowing a remaining longitudinally half portion of said first and second portions of said bag member to shift into said longitudinally half portion adjacent to said third portion by turning over inside out.

When the container is constructed in such a construction, the container is readily restored to its original flattened shape when it is dismounted from the machine in which the container was mounted to provide a source of the fluidal material, as the flattened shape is the most stress free condition of the container. When the plate member is constructed by a sheet material which preserves its stiffness and elasticity after the period of discharging the whole of the charged fluidal material, the container will automatically restore its original flattened shape or a shape close thereto when it was dismounted from the machine.

In the container of the above-mentioned construction, said plate member may have a longitudinal length which extends substantially only over said longitudinally half portion of said first and second portions of said bag member adjacent to said third portion thereof.

Or alternatively, said plate member may have a longitudinal length which extends substantially over both said longitudinally half portion of said first and second portions of said bag member adjacent to said third portion and said remaining longitudinally half portion. In this case, said plate member may be lightly fixed with said remaining longitudinally half portion of said first and second portions of said bag member so as to be readily detached therefrom when said remaining longitudinally half portion would shift into said longitudinally half portion of said bag member adjacent to said third portion.

Said third and fourth portions of said bag member may show each a hexagonal configuration when said third and fourth portion are folded to be substantially coplanar with said first and second portions in the flattened state of the container, said third and fourth portions each having in the folded state a first integral layer of said hexagonal configuration and a second combination layer of said hexagonal configuration laid below said first layer, said second layer being formed of a first trapezoidal portion connected with said first layer along three consecutive edges of said hexagonal configuration and said trapezoidal configuration thereof, respectively, and a second trapezoidal portion connected with said first layer along other three consecutive edges of said hexagonal configuration and said trapezoidal configuration thereof, respectively, said first and second trapezoidal portions each being connected with said first and second portions of said bag member along said end edges thereof with the remaining one of the four edges of said trapezoidal configuration. In such a construction, the connection between said first hexagonal layer and each one of said second trapezoidal layers may be formed with a bond seal strip along the beginning and ending edges of said three consecutive edges, said bond seal strip being substantially coplanar with said first and second portions of said bag member in the flattened state, so that the performance of restoring its original flattened shape of the container is more improved.

Said first and second portions of said plate member may be provided by an integral rectangular sheet material folded along a center line thereof to define two symmetrically rectangular sheet portions, said two symmetrically rectangular sheet portions providing said first and second portions of said plate member, respectively, for the convenience of construction of the container. In this case, opposite edges of said rectangular sheet material symmetrical to one another with respect to said center line may be bonded with said first and second portions of said bag member along one of said opposite side edges of said first and second portions of said bag member so as to be hinged thereby.

Or alternatively, said first and second portions of said plate member may be provided by a pair of symmetrically shaped rectangular sheet materials, and each of opposite edges of said rectangular sheet materials may be bonded with said first and second portions of said bag member along one of said opposite side edges of said first and second portions of said bag member so as to be hinged thereby. By such a construction the performance of restoring its flattened shape of the container will be more improved.

BRIEF DESCRIPTION OF THE DRAWINGS

In the accompanying drawings.

DESCRIPTION OF THE EMBODIMENTS

In the following, the present invention will be described in more detail in the form of some preferred embodiments with reference to the accompanying drawings.

Figure 1:
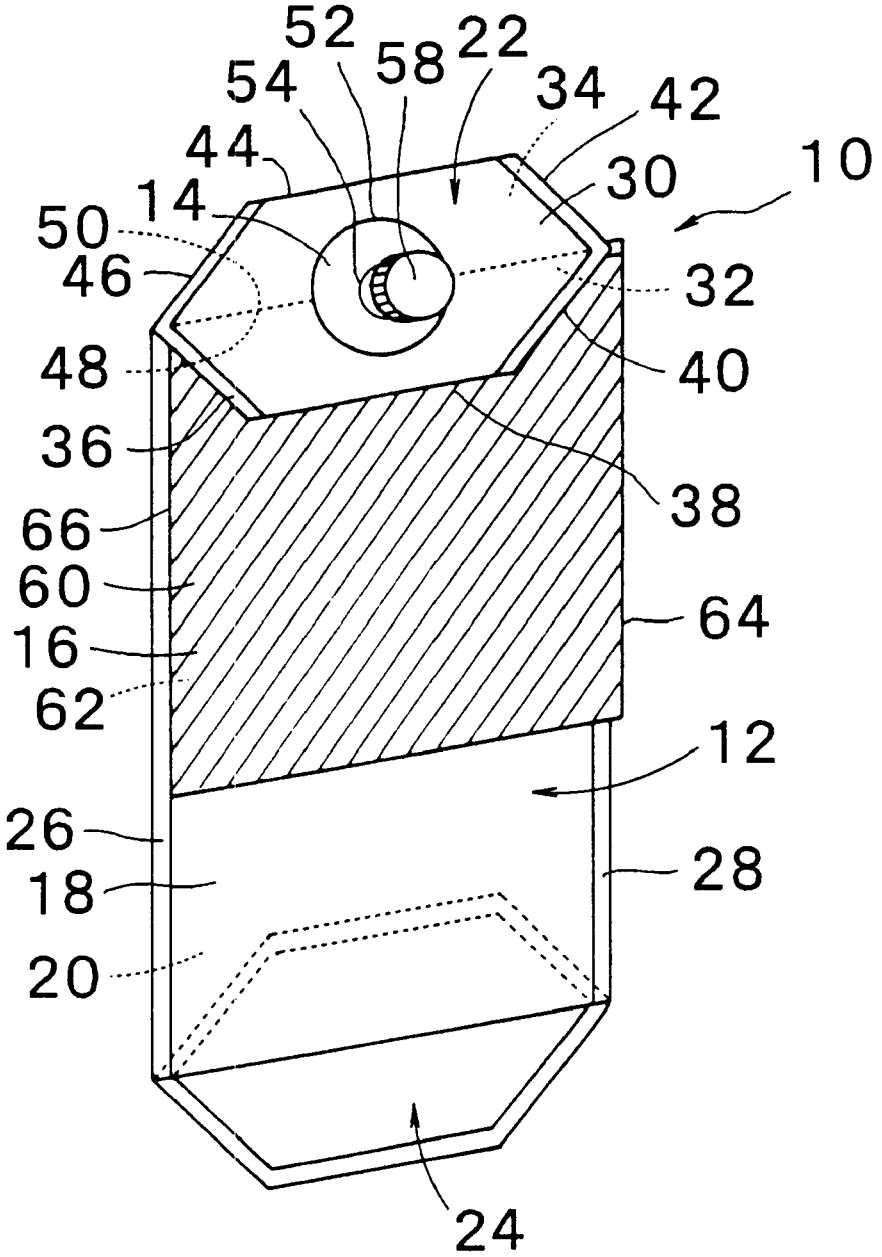
FIG. 1 is a perspective view showing a first embodiment of the container according to the present invention in a flattened state.

Referring first to FIG. 1, the container generally designated by 10 is, as analyzed of its construction for the convenience of description, constructed by a bag member 12 made of a flexible film material such as a soft synthetic resin film, a port member 14 made of a relatively rigid material such as a hard synthetic resin, and a plate member 16 made of a relatively stiff and elastic light sheet material which exhibits a stabilized cylindrical configuration when it is so formed like an ordinary cardboard.

The bag member 12 includes a first rectangular portion 18, a second rectangular portion 20 of the same rectangular configuration as the portion 18 and positioned behind the portion 18 as viewed in FIG. 1, a third portion 22 adapted to close an upper end of a tubular configuration formed by the first and second portions 18 and 20 when the container is expanded as described hereinbelow, and a fourth portion 24 adapted to close a lower end of the tubular configuration formed by the first and second portions 18 and 20. However, it is to be noted that the above-mentioned first through fourth portions are discriminated only for the convenience of describing the construction of the bag member 12 and that some or all of them may be constructed to be integral with one another by a common flexible film material according to some known bag making technique such as a blow molding of a molten plastic material.

In the embodiment shown in FIG. 1, the first and second portions 18 and 20 are connected with one another along opposite side edges 26 and 28 thereof by forming bond seal strips. When the opposite side edges 26 and 28 are formed with those bond seal strips, instead of a mere folded integral edge of a continuous film material, the bag member 12 shows a performance of automatically more readily flattening when the fluidal material charged therein has exhausted out therefrom.

The third portion 22 shows a hexagonal configuration as seen in FIG. 1 when the container is in the flattened state, the hexagonal configuration including indeed two layers of the film material. The upper layer is a film portion 30 integral over the entire region of the hexagonal configuration, while the lower layer is a parallel combination of two trapezoidal film portions 32 and 34. The film portion 30 is connected with the film portion 32 along three consecutive edges 36, 38 and 40, while it is connected with the film portion 34 along three consecutive edges 42, 44 and 46. The trapezoidal film portion 32 is connected with the first portion 18 along the remaining one of the four edges thereof with the corresponding end edge of the first portion 18, as shown by 48 designating the edge common to the two adjacent portions 32 and 18. Similarly, the trapezoidal film portion 34 is connected with the second portion 20 along the remaining one of the four edges thereof with the corresponding end edge of the second portion 20, as shown by 50 designating the edge common to the two adjacent portions 34 and 20. In the shown embodiment, the edges 36, 40, 42 and 46 are formed with bond seal strips which assist the third portion 22 to automatically readily flatten as shown in FIG. 1 when the fluidal material charged in the container has been exhausted.

The port member 14 has a base disk portion 52 and a nozzle portion 54 formed integral with the base disk portion 52. The port member 14 fringes a port opening 56 (FIG. 3) formed in the film portion 30 to provide a nozzle means for discharging the fluidal material charged in the container therethrough. The tip end of the nozzle portion 54 is closed by a cap 58 mounted thereto when the container has been prepared with a charge of a fluidal material, and when the container has been used with the charged fluidal material having been completely exhausted therefrom.

The construction of the fourth portion 24 closing the lower end of the tubular configuration made of the first and second portions 18 and 20 is substantially the same as that of the third portion 22, except that no other member such as the port member 14 is mounted thereto, and that all of the six edges of a hexagonal film portion corresponding to the film portion 30 are formed with a bond seal strip similar to that formed at the edges the 36, 40, 42 and 46. Therefore, further detailed descriptions about the fourth portion 24 will be omitted to avoid a redundancy of the description.

Materials usable for constructing the bag member 12 are polyethylene, polypropylene, polyester, nylon, polystyrene, polyvinyl chloride, polyvinyl alcohol, polycarbonate, EVOH, fluoric resin, polymethyl methacrylate, polybutane, etc. Cellophane will also be usable. Further, the films made of the above materials may be coated by a thin layer of aluminum, silicon, oxide of aluminum, PVDC, EVOH, wax or like. The port member 14 may be formed by acrylic resin, epoxy resin, etc.

The plate member 16 in the embodiment of FIG. 1 has a construction that a rectangular sheet material such as a cardboard is folded along a center line to define two congruent rectangular sheet portions 60 and 62 integrally connected along an edge 64 following the center line, the two sheet portions 60 and 62 sandwiching a longitudinally upper half of the tubular configuration made of the first and second portions 18 and 20, adjacent to the third portion 22. The opposite side edges 66 of the folded rectangular sheet material terminate along the inside edge of the bond seal strip formed along the side edges 26 of the bag member and are bonded to the film material forming the bag member so as to be hinged thereby. Or alternatively, they may further extend to be bonded to one another together with the corresponding part of the side edges 26 of the first and second portions 18 and 20, so as to form a common bond seal strip therealong. In this case, it is desirable that the plate member 16 is formed with a series of small perforations along a line which defines the inside edge of such a common bond seal strip so as to facilitate bending of the plate member therealong when it is expanded into the tubular configuration.

As already described, the plate member 16 may desirably be made of a cardboard which is relatively easily deformed under a small force, while showing a desirable degree of stiffness and elasticity which provides a firm cylinder means when the plate member made of the two sheet portions 60 and 62 is expanded from its inside, for supporting and protecting the film bag made of the bag member 12 charged with a fluidal material such as a viscous stencil printing ink until the fluidal material is completely discharged through the port member 14 as described hereinbelow, and still would restore its original flattened shape when the expanding force is removed to let the container flatly collapsed for disposal by a minimum volume.

Figure 2:
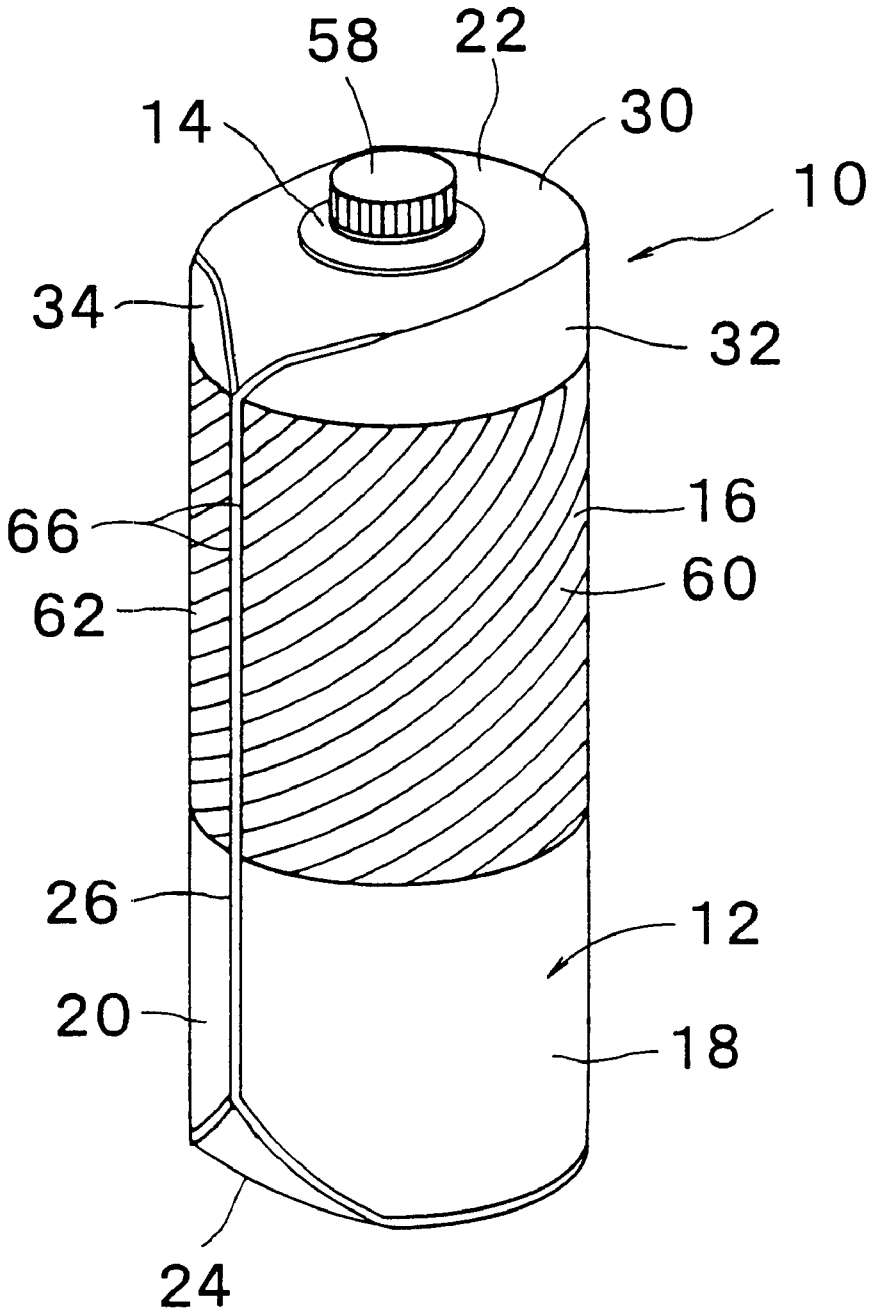
FIG. 2 is a perspective view of the container shown in FIG. 1 in an expanded state.

FIG. 2 shows the container 10 of FIG. 1 in its expanded state with a fluidal material being charged in the bag member 12. In FIG. 2, the portions corresponding to those shown in FIG. 1 are designated by the same reference numerals. It will be appreciated that the container having a flattened shape as shown in FIG. 1 in its collapsed state provides a substantially cylindrical container when it was expanded by a fluidal material from the inside thereof. In this connection, it will also be appreciated that each of the third and fourth portions 22 and 24 constructed as a combination of the hexagonal portion 30 and the two trapezoidal portions 32 and 34 provides the bag member 12 with a substantially domed end under a flexible deformation of the film material constructing the bag member.

Figure 3:
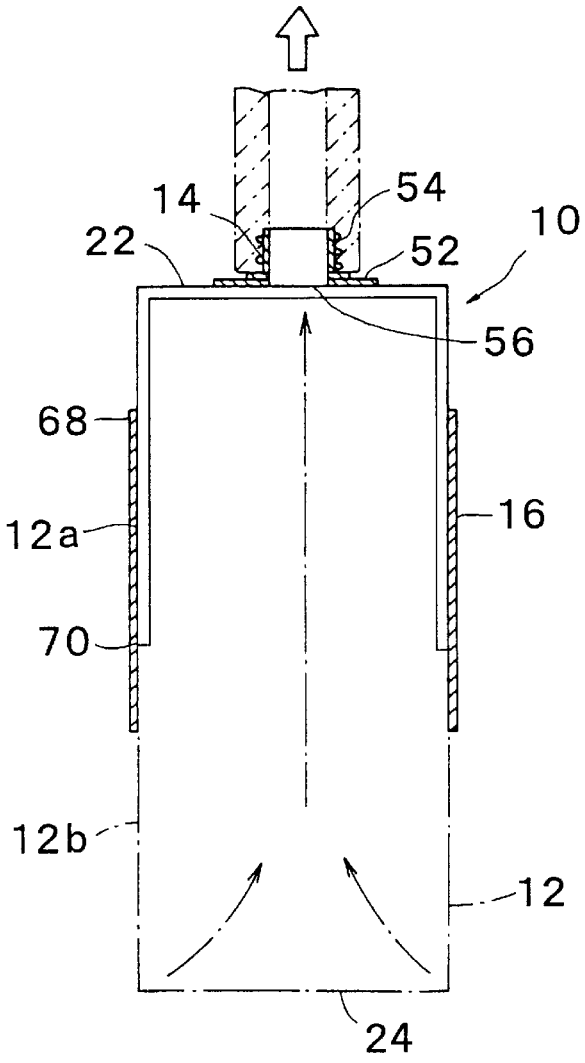
FIG. 3 is a somewhat diagrammatical sectional view of the container shown in FIG. 1 or 2, also showing the manner of the lower half portion of the bag member being shifted into the upper half portion thereof according to drawing out of the content through the port member.

FIG. 3 shows in a somewhat diagrammatical illustration how the bag member 12 is deformed according to the discharge of the fluidal material charged therein. In FIG. 3, the portions corresponding to those shown in FIG. 1 are also designated by the same reference numerals. The plate member 16 is fixed with the bag member 12 such that a longitudinally half portion 12*a* of the bag member adjacent to the third portion 22 is maintained in the longitudinally extended state, while the remaining longitudinally half portion 12*b* of the bag member is allowed to shift into the longitudinally half portion 12*a* by turning over inside out according to the discharge of the fluidal material charged in the bag member trough the port 56, as indicated by arrows.

Such a fixing of the plate member 16 with the bag member 12 may be effected by the whole overlapped surfaces of the two members being uniformly, strip-patterned, dot-patterned or sporadically bonded by an adhesive proper to the both material. Alternatively, the overlapped surfaces may be bonded together only along a few relatively narrow annular strip areas such as 68 and 70.

Figure 4:
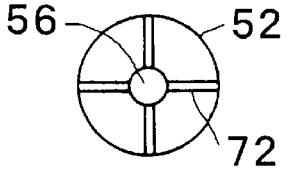
FIG. 4 is a bottom view of the port member shown in FIG. 5, incorporating a modification for ensuring a complete discharge of the fluidal material from the container.

In order for allowing the fluidal material to be completely discharged when the free end of the bag member 12 formed by the fourth portion 24 approached the port opening 56, an annular portion at which the disk portion 52 of the port member 14 is integrally bonded with the corresponding annular portion of the film material forming said third portion 22 may be formed with radial grooves 72 as shown in FIG. 4, so as to provide flow passages for the last amount of the fluidal material toward the port opening 56.

Figure 5:
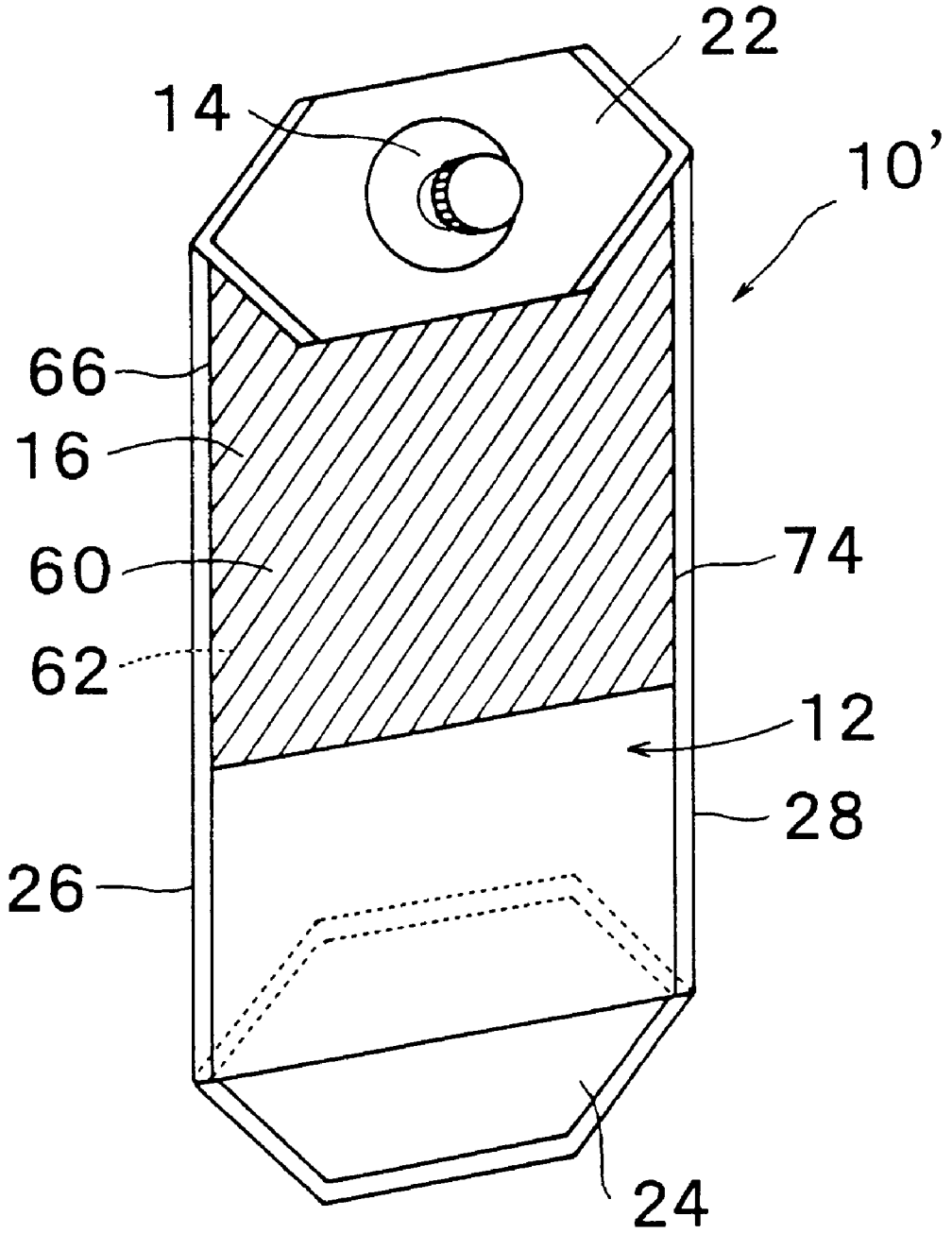
FIG. 5 is a plan view similar to FIG. 1, showing a second embodiment of the container according to the present invention.

FIG. 5 is a view similar to FIG. 1, showing another embodiment of the container according to the present invention. The container 10' of this embodiment is different from the embodiment shown in FIG. 1 only in that the sheet portions 60 and 62 of the plate member 16 are made of separate sheets, with other edges 74 terminating along the inside edge of the bond seal strip formed by the side edges 28 of the bag member and bonded to the film material forming the bag member so as to be hinged thereby. Or alternatively, the edges 74 may also further extend to be bonded together with the corresponding edges 28 of the bag member to form an integral bond seal strip therewith. This embodiment may more readily flatten to restore its original shape than the first embodiment shown in FIG. 1 when the fluidal material has been discharged from the container. In FIG. 1, some principal portions corresponding to those shown in FIG. 1 are designated by the same reference numerals. Since the construction of the embodiment of FIG. 5 will be obvious in contrast to FIG. 1, further descriptions are omitted to avoid a redundancy of the description.

Figure 6:
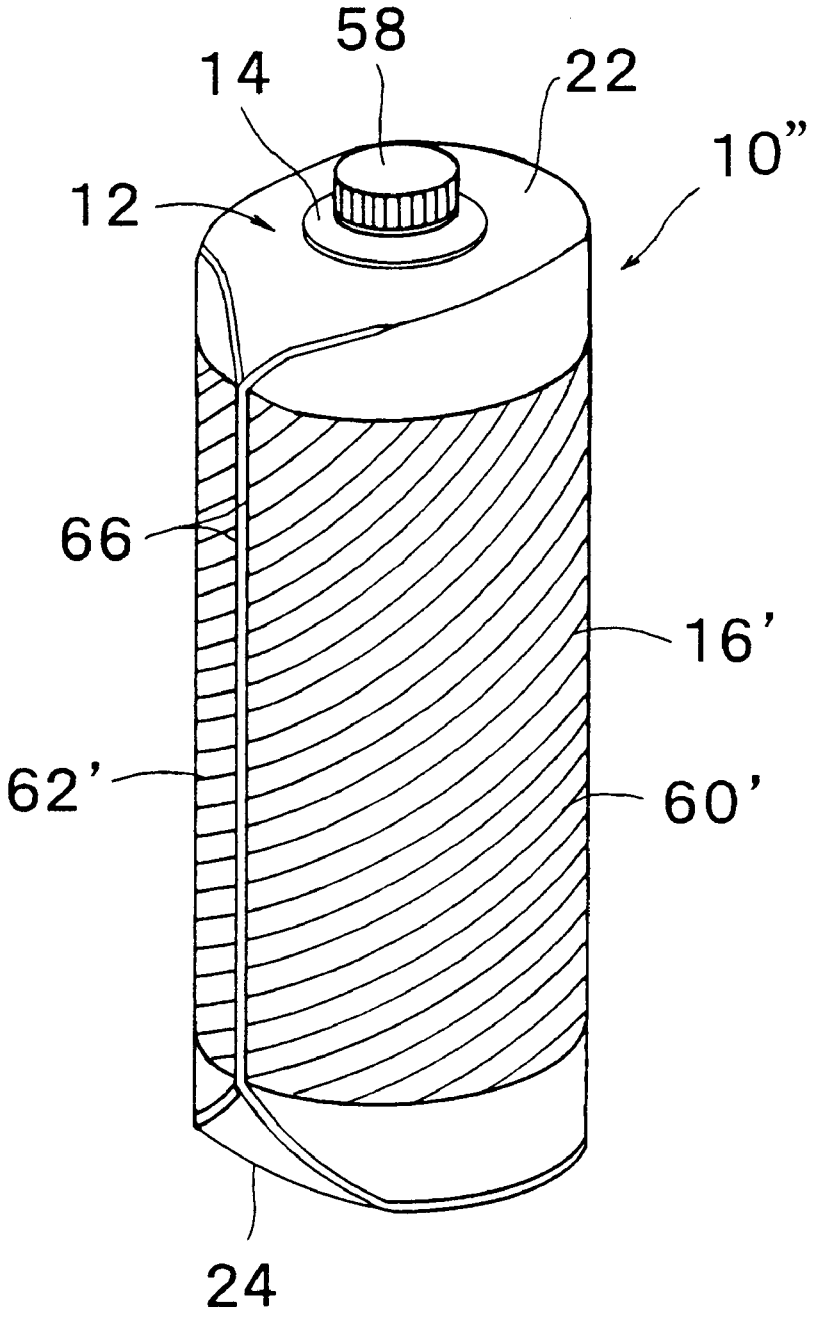
FIG. 6 is a perspective view similar to FIG. 2, showing a third embodiment of the container according to the present invention.

FIG. 6 is a view similar to FIG. 2, showing still another embodiment, of the container according to the present invention. The container 10" of this embodiment is different from the embodiment shown in FIGS. 1–3 only in that the plate member 16 is extended to cover the whole length of the tubular portion of the bag member 12 formed of said first and second portions 18 and 20. This embodiment will provide a container which is more rigid and stable for transportation and mounting into the machine than the embodiment shown in FIGS. 1–3, although the mass for disposal after the use increases correspondingly. In FIG. 6, some principal portions corresponding to those shown in FIG. 2 are designated by the same reference numerals. As a first modification, the plate member 16' corresponding to the plate member 16 of FIG. 2 and constructed by a larger sheet material to provides sheet portions 60' and 62' is not fixed with the bag member 12 housed therein at a longitudinally half portion thereof remote from the port member 14. However, as a second modification, the plate member 16' may be fixed with the longitudinally half portion thereof remote from the port member 14 in such a manner that the fixture is readily removable when the corresponding longitudinal half portion of the bag member is drawing toward the port member 14 according to the discharge of the fluid material charged in the container. Since the construction of the embodiment of FIG. 6 will be obvious with respect to other points in contrast to FIG. 2, further descriptions are omitted to avoid a redundancy of the description.

The containers 10, 10' or 10" are generally intended to be used to provide a source of a fluidal material in a machine, such as an ink source in a printing machine. Therefore, the container is generally used as charged into a space prepared in a machine, with a means for drawing out the fluidal material from the container by connection to the nozzle portion of the container. If the space prepared in the machine for mounting the container has a wall means to restrict the cylindrical configuration of the container at its initial state expanded with a full charge of the fluidal material, the container, particularly the plate member 16 thereof, is kept at the cylindrically expanded configuration even when container approaches its exhausted condition by the drawing out of the fluidal material therefrom. However, if the space for mounting the container in the machine is not so designed as to restrict the cylindrical configuration of the container, the container will gradually flattens according to the discharge of the content thereof. In such a case, in order to ensure the perfect discharge of the fluidal material to the last droplet, with the bag member 12 being completely turned over inside out as diagrammatically shown in FIG. 3, it is desirable that the container is charged into a reinforcing case such as shown in FIGS. 7, 8 and 9, before being charged into the machine.

Figure 7:
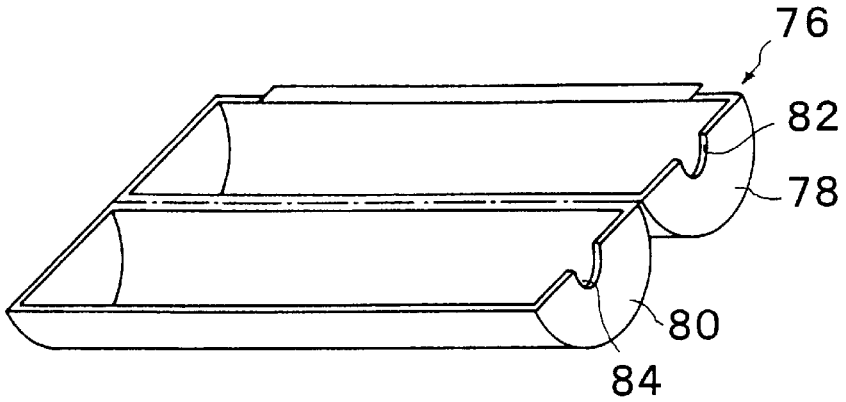
FIGS. 7, 8 and 9 are perspective views showing the manner of encasing the container shown in FIGS. 1–3 into a reinforcing case.
Figure 8:
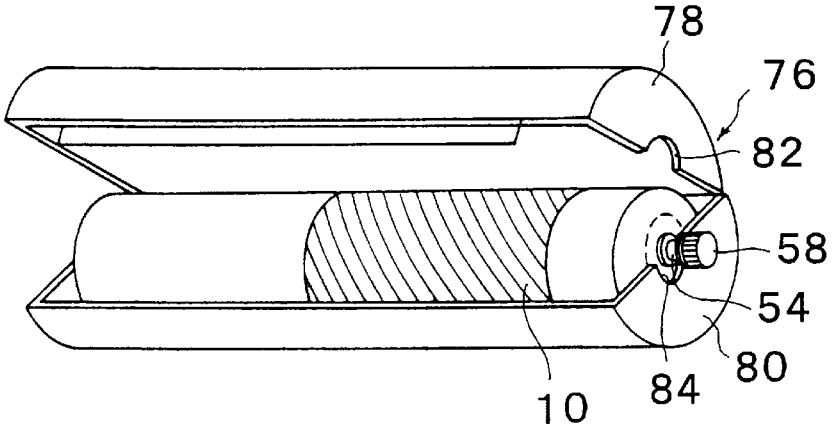
Figure 9:
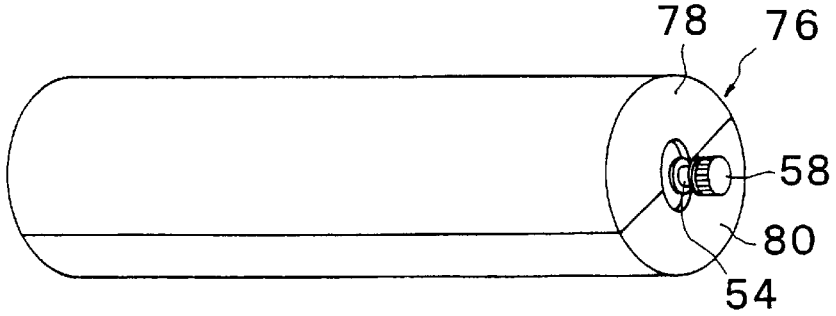

FIGS. 7, 8 and 9 show a manner of using the container of the construction described with reference to FIGS. 1–3 with such a reinforcing case 76 generally cylindrical and openable by a hinge means (not shown) as a parallel combination of trough like halves 78 and 80, each formed with a half circular notch 82 or 84 to receive the nozzle portion 54 of the container 10. Since the general construction of the reinforcing case 76 and the manner of charging and discharging the container into and out of the reinforcing case will be obvious from the illustration by FIGS. 7–9, further detailed descriptions about the combination will be omitted to avoid a redundancy of the description.

Figure 10:
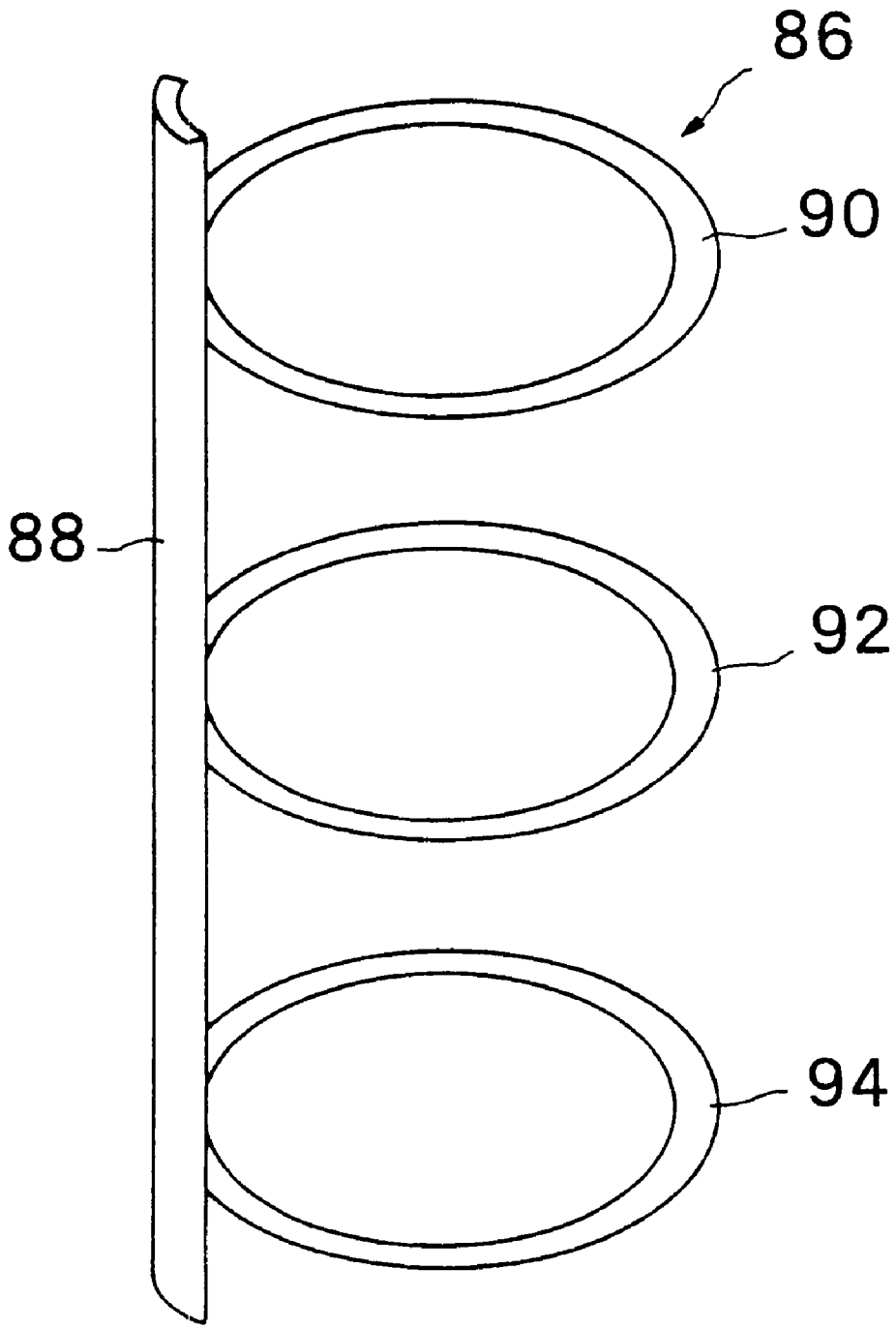
FIG. 10 is a perspective view of a device for convenience for maintaining the initial expanded state of the container according to the present invention.
Figure 11:
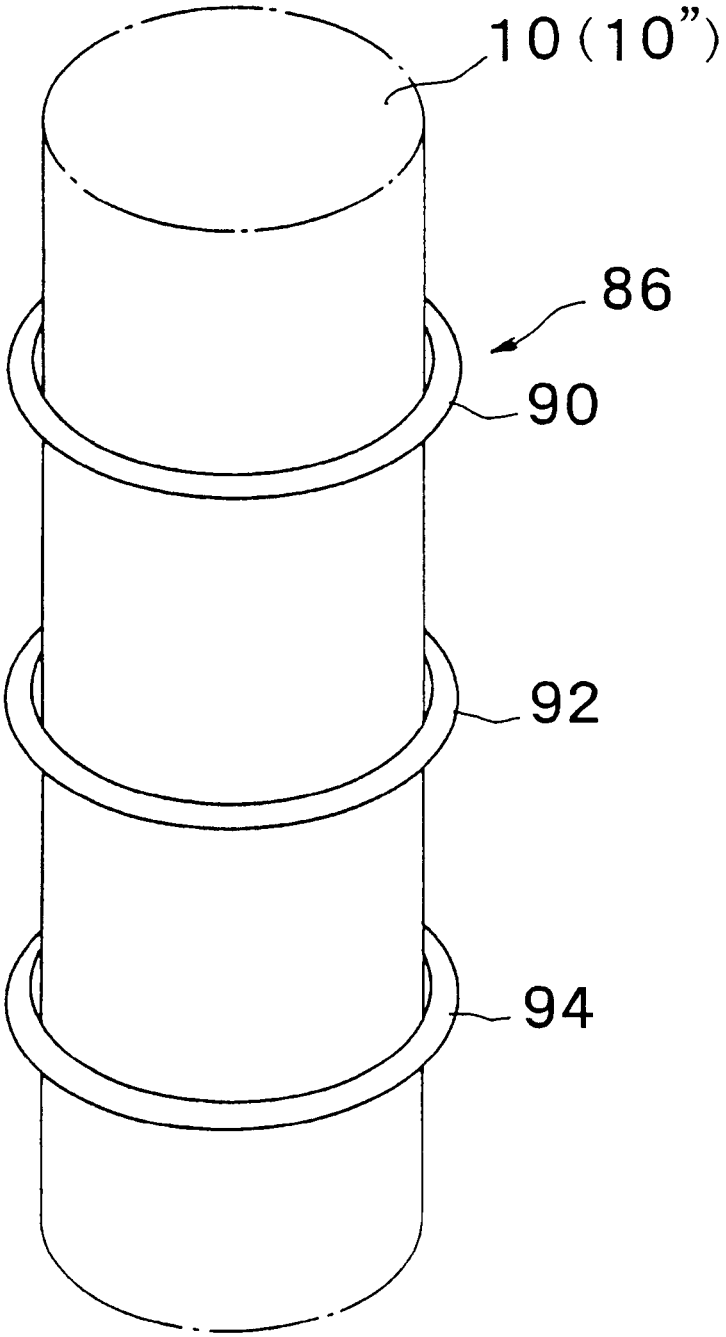
FIG. 11 is a somewhat diagrammatical perspective view showing the manner of use of the device of FIG. 10 for the container according to the present invention.

FIGS. 10 and 11 show another possibility of maintaining the expanded state of the containers 10, 10' and 10", particularly at the plate member 16, as prepared for the case that the container charging space of a machine which uses the containers does not restrict the plate member 16 at its initial fully expanded state. As will be obvious from these figures, here is provided a relatively simple device 86 composed of a linear member 88 and a plurality of (three in the shown embodiment) ring member 90, 92 and 94 firmly connected to the linear member 88 as appropriately space therealong.

It is desirable that these members are all made of a relatively stiff and elastic material. The shown embodiment of the device 86 is particularly suited for the container shown in FIG. 6 having a full length plate member 16. By the container being inserted through the ring members of such a device, the plate member 16 is maintained at its initial fully expanded state even after the fluidal material has been complete exhausted from the container.

Although the present invention has been described in detail with respect to some preferred embodiments thereof, it will be apparent for those skilled in the art that various modifications are possible with respect to the shown embodiments within the scope of the present invention.

We claim:

1. A container for fluidal materials, comprising:

a bag member made of a flexible film material, said bag member defining an inner space therein sealed against an outer atmosphere except a port opening formed therein, said bag member including a first and a second substantially rectangular portion adapted to show a same plane configuration when the container is in a flattened state, said first and second portions of said bag member being connected with one another along opposite side edges thereof so as to show a tubular configuration with opposite end edges thereof defining a pair of annular edges of the tubular configuration of said bag member when said inner space is charged with a fluidal material, said bag member further including a third portion closing one end of said tubular configuration along one of said pair of annular edges thereof except said port opening formed therein and a fourth portion closing another end of said tubular configuration along another of said pair of annular edges thereof, said third and fourth potions each being foldable to be substantially coplanar with said first and second portions when the container is in the flattened state, a port member mounted to said bag member at said third portion thereof, said port member defining a nozzle for discharging the fluidal material charged in the inner space of said bag member therefrom through said port opening of said bag member, and a plate member mounted over said bag member, said plate member including a first and a second substantially rectangular portion adapted to show a substantially same plane configuration when the container is in the flattened state, said first and second portions of said plate member being adapted to show a tubular configuration when said inner space is charged with the fluidal material, said plate member being fixed with said bag member such that a longitudinally half portion of said first and second portions of said bag member adjacent to said third portion thereof is maintained in a longitudinally extended state, while allowing a remaining longitudinally half portion of said first and second portions of said bag member to shift into said longitudinally half portion thereof adjacent to said third portion by turning over inside out.

2. A container according to claim 1, wherein said plate member has a longitudinal length which extends substantially only over said longitudinally half portion of said first and second portions of said bag member adjacent to said third portion thereof.

3. A container according to claim 1, wherein said plate member has a longitudinal length which extends substantially over both said longitudinally half portion of said first and second portions of said bag member adjacent to said third portion and said remaining longitudinally half portion of said bag member.

4. A container according to claim 3, wherein said plate member is lightly fixed with said remaining longitudinally half portion of said first and second portions of said bag member so as to be readily detached therefrom when said remaining longitudinally half portion of said first and second portions of said bag member would shift into said longitudinally half portion of said first and second portions of said bag member adjacent to said third portion.

5. A container according to claim 1, wherein said third and fourth portions of said bag member show each a hexagonal configuration when said third and fourth portion are folded to be substantially coplanar with said first and second portions in the flattened state of the container, said third and fourth portions each having in the folded state a first integral layer of said hexagonal configuration and a second combination layer of said hexagonal configuration laid below said first layer, said second layer being formed of a first trapezoidal portion connected with said first layer along three consecutive edges of said hexagonal configuration and said trapezoidal configuration thereof, respectively, and a second trapezoidal portion connected with said first layer along other three consecutive edges of said hexagonal configuration and said trapezoidal configuration thereof, respectively, said first and second trapezoidal portions each being connected with said first and second portions of said bag member along said end edges thereof with the remaining one of the four edges of said trapezoidal configuration.

6. A container according to claim 5, wherein the connection between said first hexagonal layer and each one of said second trapezoidal layers is formed with a bond seal strip along the beginning and ending edges of said three consecutive edges, said bond seal strip being substantially coplanar with said first and second portions of said bag member in the flattened state.

7. A container according to claim 1, wherein said first and second portions of said plate member are provided by an integral rectangular sheet material folded along a center line thereof to define two symmetrically rectangular sheet portions, said two symmetrically rectangular sheet portions providing said first and second portions of said plate member, respectively.

8. A container according to claim 7, wherein opposite edges of said rectangular sheet material symmetrical to one another with respect to said center line are bonded with said first and second portions of said bag member along one of said opposite side edges of said first and second portions of said bag member so as to be hinged thereby.

9. A container according to claim 1, wherein said first and second portions of said plate member are provided by a pair of symmetrically shaped rectangular sheet materials, and each of opposite edges of said rectangular sheet materials are bonded with said first and second portions of said bag member along one of said opposite side edges of said first and second portions of said bag member so as to be hinged thereby.

* * * * *